US011395565B1

(12) United States Patent
Brazell

(10) Patent No.: US 11,395,565 B1
(45) Date of Patent: Jul. 26, 2022

(54) ROLLED SHEET DISPENSER ASSEMBLY

(71) Applicant: Charles Brazell, Redford, MI (US)

(72) Inventor: Charles Brazell, Redford, MI (US)

( * ) Notice: Subject to any disclaimer, the term of this patent is extended or adjusted under 35 U.S.C. 154(b) by 0 days.

(21) Appl. No.: 17/166,100

(22) Filed: Feb. 3, 2021

(51) Int. Cl.
*B26D 5/08* (2006.01)
*B26D 7/00* (2006.01)
*A47K 10/36* (2006.01)

(52) U.S. Cl.
CPC ..... *A47K 10/3631* (2013.01)

(58) Field of Classification Search
CPC .... B26D 1/045; B65H 35/00; B65H 2301/05; B65H 35/0086; B65H 35/002; B65H 2701/944; B65H 35/0006; B65H 16/024; B65H 2408/241; Y10T 83/8822; Y10T 83/896; Y10T 83/7487; Y10T 225/297; Y10T 225/238; Y10T 225/057
USPC ..... 83/322, 614, 649, 648, 445, 56, 650; 225/39, 56, 90, 91, 47, 53, 77, 35, 42, 46
See application file for complete search history.

(56) References Cited

U.S. PATENT DOCUMENTS 3,236,427 A * 2/1966 Martin ..... B65H 35/0006 D18/49
3,642,336 A 2/1972 Harvey, Sr.
4,779,780 A * 10/1988 Scharf ..... B65H 35/0006 225/42
4,832,271 A * 5/1989 Geleziunas ..... A47K 10/3809 206/408
5,011,059 A 4/1991 Jennings, Jr.
5,186,376 A * 2/1993 Scharf ..... B26D 7/2614 225/80
5,275,073 A * 1/1994 Zemlak ..... B26F 3/12 83/171
5,947,360 A * 9/1999 Frank ..... B65H 35/06 225/39
6,959,635 B2 * 11/2005 Tramontina ..... A47K 10/38 225/72
7,000,520 B2 * 2/2006 Nichols ..... B26D 1/105 83/578
7,424,843 B2 9/2008 Guillory
D637,027 S 5/2011 Withers
8,479,626 B1 * 7/2013 Winkler ..... B26D 1/205 83/613
11,267,150 B1 * 3/2022 Smith ..... B26D 1/105
2009/0293695 A1 12/2009 Sacchetta
2010/0025066 A1 * 2/2010 de la Borbolla ..... H02G 3/18 174/57
2012/0074161 A1 3/2012 Efthimiadis
2017/0008722 A1 1/2017 Filipescu

* cited by examiner

*Primary Examiner* — Ghassem Alie

(57) ABSTRACT

A rolled sheet dispenser assembly for dispensing a cutting a selected length of a rolled sheet includes a housing that has a plurality of mounting holes integrated for mounting to a horizontal support surface. The housing has a dispensing slot extending into an interior of the housing to facilitate a rolled sheet positioned in the housing to be drawn outwardly through the dispensing slot. A pair of holders is each of the holders is coupled to the housing to engage a respective end of the rolled sheet. A base is removably attachable to the housing and a cutter is slidably coupled to the base. The cutter is slidable laterally along the base to cut the length of rolled sheet that has been drawn outwardly from the housing.

9 Claims, 7 Drawing Sheets

ROLLED SHEET DISPENSER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dispenser device and more particularly pertains to a new dispenser device for dispensing a cutting a selected length of a rolled sheet. The device includes a housing and a pair of holders in the housing for retaining a rolled sheet in the housing. Additionally, a cutter is slidably integrated into the device for cutting a section of the rolled sheet to a desired length.

(2) Description of Related Art Including Information Disclosed Under 37 CFR 1.97 and 1.98

The prior art relates to dispenser devices including a variety is rolled sheet dispensers that have a sliding cutter integrated on a housing. In each case the sliding cutter is either on a top of the housing or the sliding cutter is mounted on a pivoting arm. The prior art discloses a dispenser that holds a plurality of rolled sheets and which includes a plurality of slidable cutters for cutting the rolled sheets. In no instance does the prior art disclose a housing that has a sliding cutting integrated on a base of the housing.

BRIEF SUMMARY OF THE INVENTION

An embodiment of the disclosure meets the needs presented above by generally comprising a housing that has a plurality of mounting holes integrated for mounting to a horizontal support surface. The housing has a dispensing slot extending into an interior of the housing to facilitate a rolled sheet positioned in the housing to be drawn outwardly through the dispensing slot. A pair of holders is each of the holders is coupled to the housing to engage a respective end of the rolled sheet. A base is removably attachable to the housing and a cutter is slidably coupled to the base. The cutter is slidable laterally along the base to cut the length of rolled sheet that has been drawn outwardly from the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
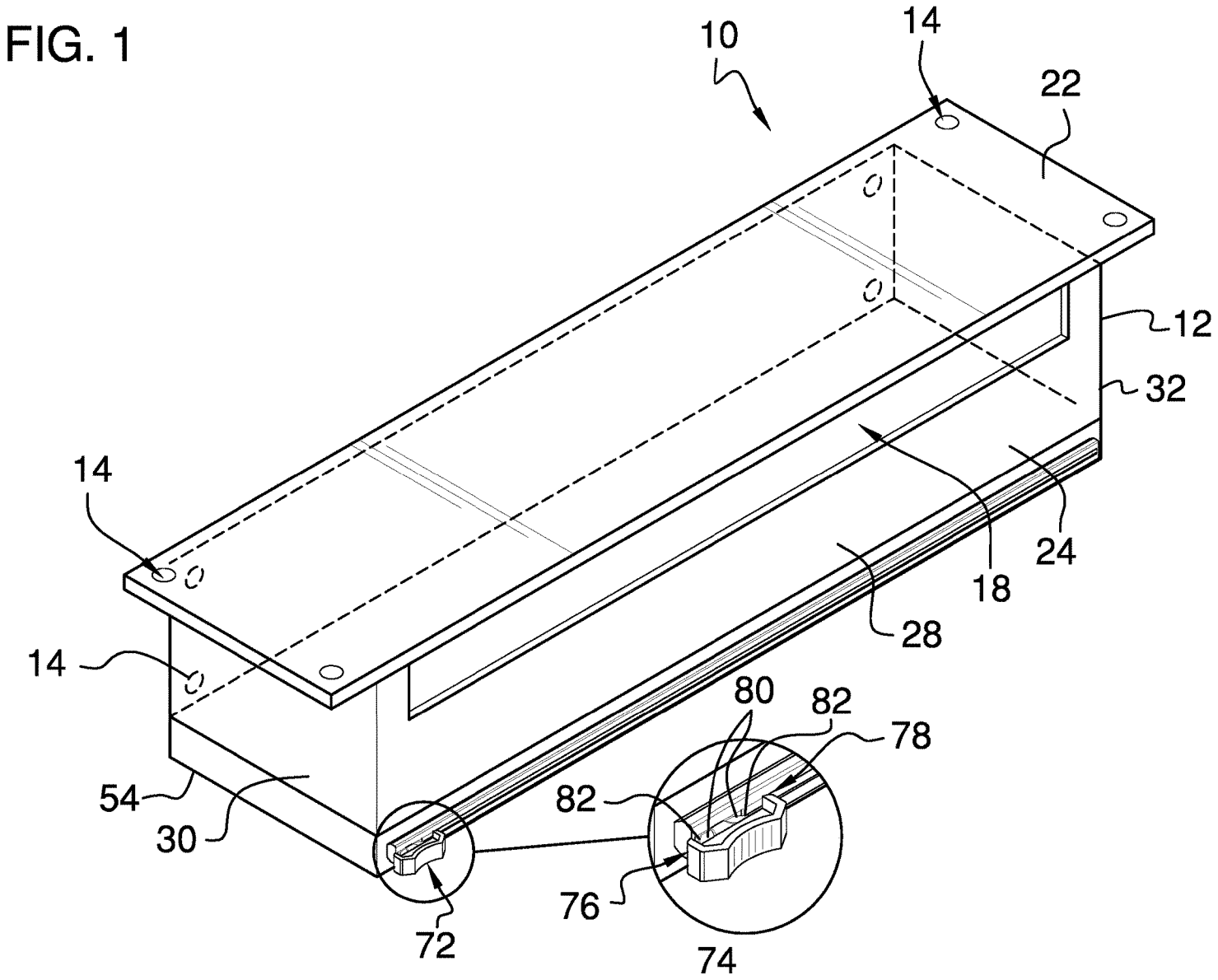
FIG. 1 is a perspective phantom view of a rolled sheet dispenser assembly according to an embodiment of the disclosure.
Figure 2:
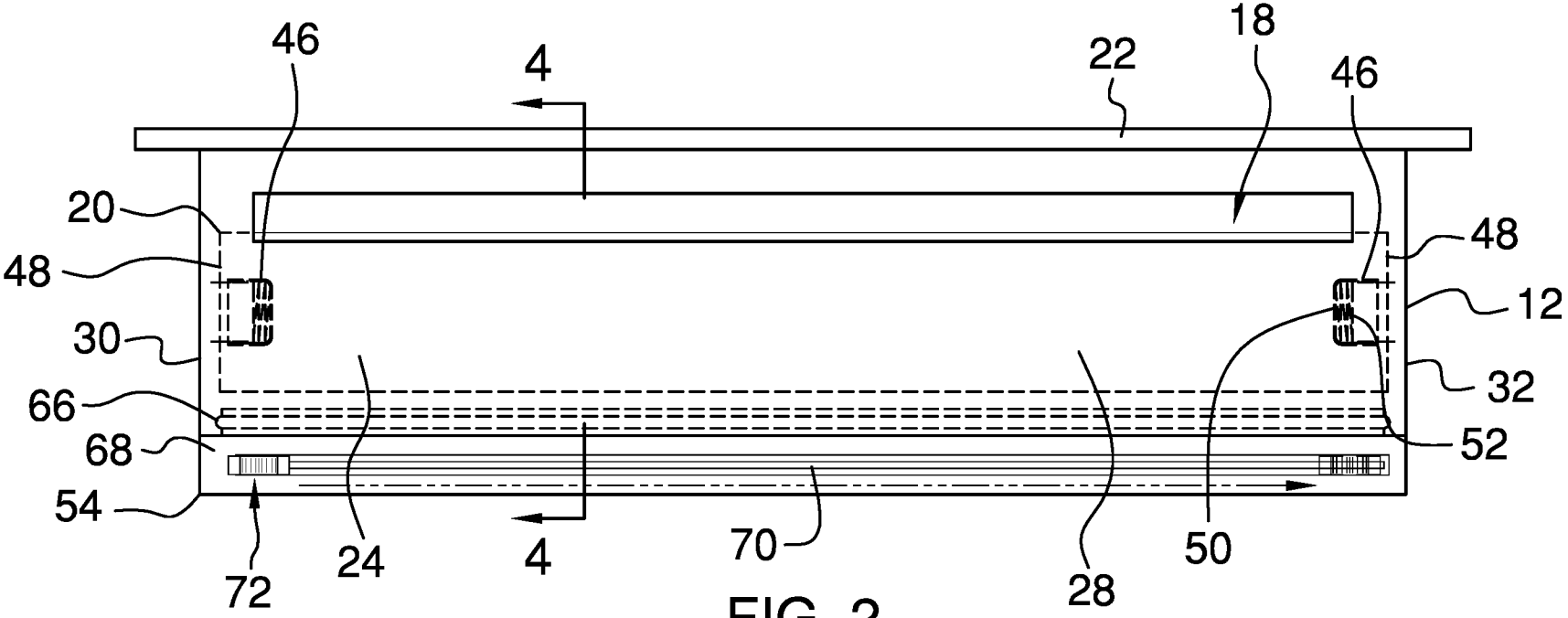
FIG. 2 is a front phantom view of an embodiment of the disclosure.
Figure 3:
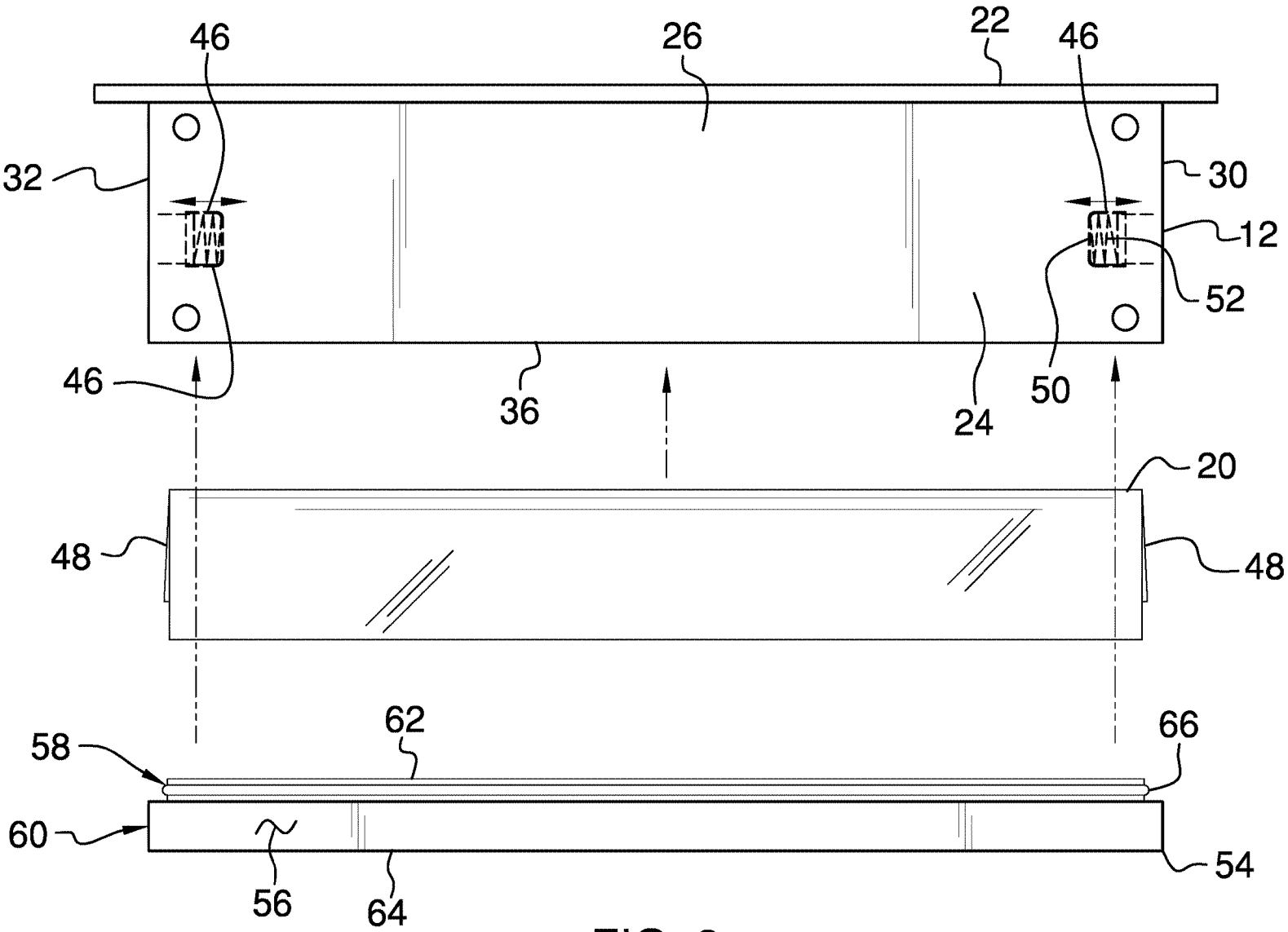
FIG. 3 is an exploded back view of an embodiment of the disclosure.
Figure 5:
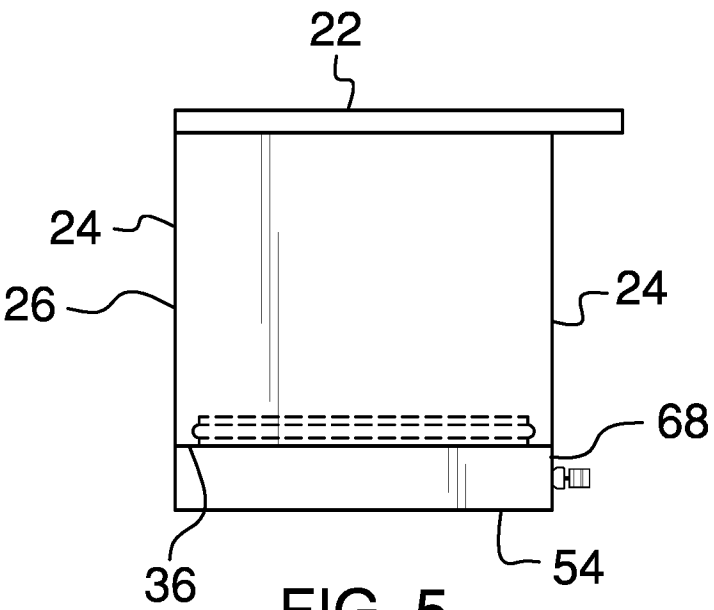
FIG. 5 is a left side phantom view of an embodiment of the disclosure.
Figure 4:
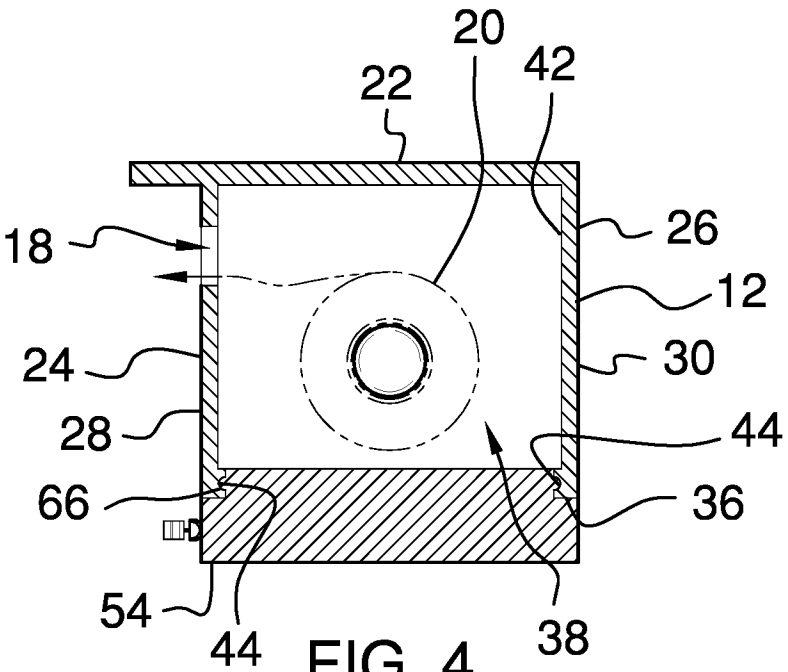
FIG. 4 is a cross sectional view taken along line 4-4 of FIG. 2 of an embodiment of the disclosure.
Figure 6:
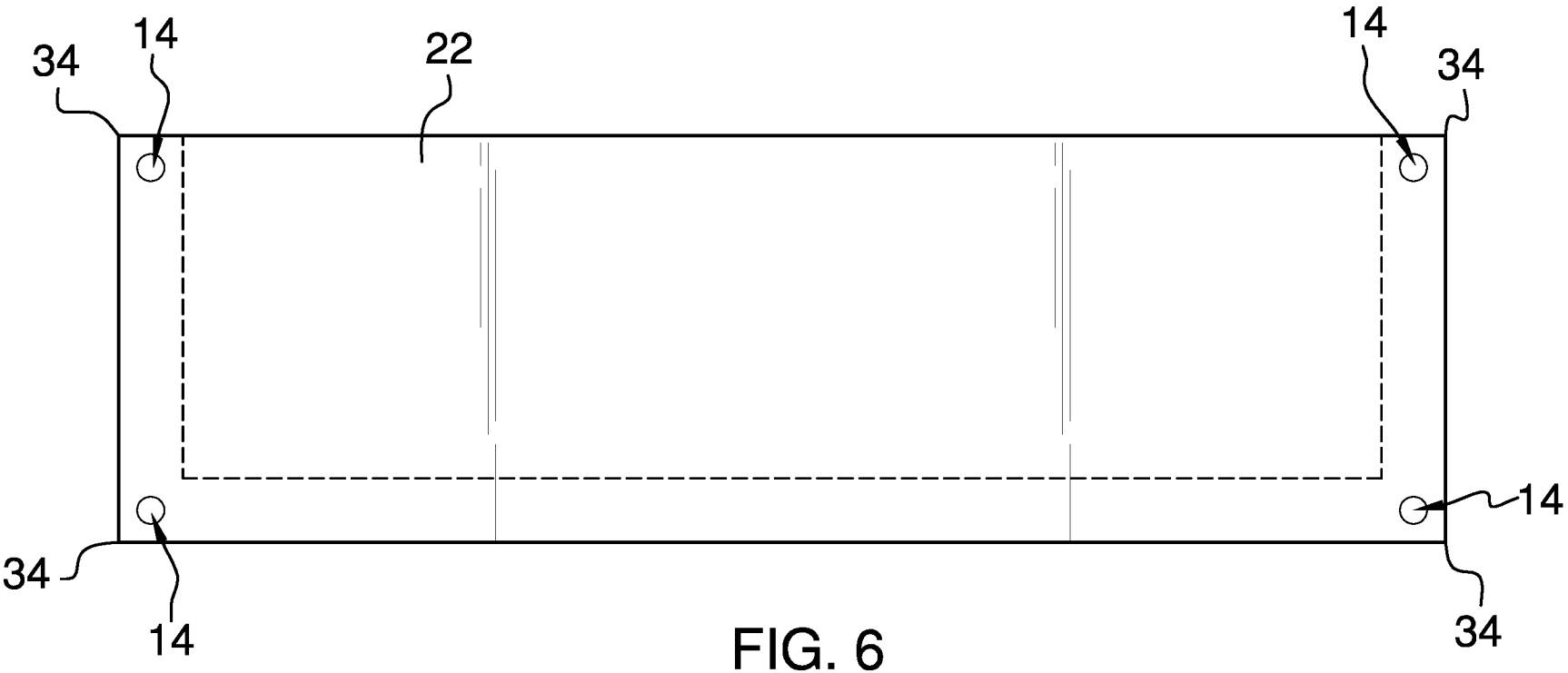
FIG. 6 is a top phantom view of an embodiment of the disclosure.
Figure 7:
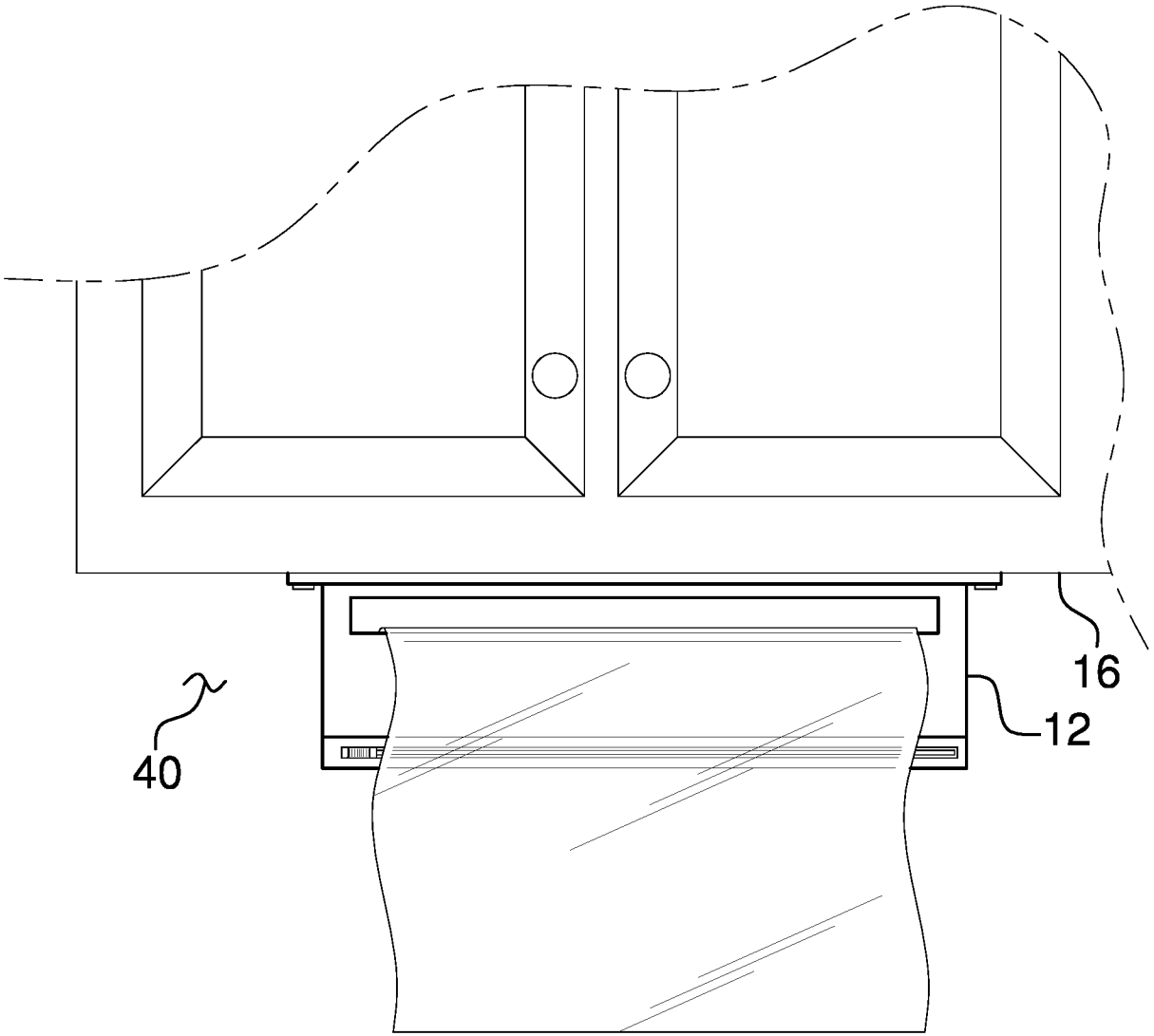
FIG. 7 is a perspective in-use view of an embodiment of the disclosure.

With reference now to the drawings, and in particular to FIGS. 1 through 8 thereof, a new dispenser device embodying the principles and concepts of an embodiment of the disclosure and generally designated by the reference numeral 10 will be described.

As best illustrated in FIGS. 1 through 8, the rolled sheet dispenser assembly 10 generally comprises a housing 12 that has a plurality of mounting holes 14 integrated therein such that the housing 12 can be mounted to a horizontal support surface 16. The horizontal support surface 16 may be the bottom side of a kitchen cabinet or other accessible horizontal support surface 16. The housing 12 has a dispensing slot 18 extending into an interior of the housing 12 to facilitate a rolled sheet 20 positioned in the housing 12 to be drawn outwardly through the dispensing slot 18. The rolled sheet 20 may be a rolled sheet of cellophane, wax paper or any other type of product that might be used in a kitchen or other food preparation environment.

The housing 12 has a top wall 22 and an outer wall 24 extending downwardly therefrom, and the outer wall 24 has a back side 26, a front side 28, a first lateral side 30 and a second lateral side 32. The top wall 22 extends outwardly beyond each of the first lateral side 30, the second lateral side 32 and the front side 28. The top wall 22 has respective ones of the mounting holes 14 extending therethrough and each of the mounting holes 14 is positioned on respective portions of the top wall 22 that extend beyond the first lateral side 30 and the second lateral side 32 of the outer wall 24. Additionally, each of the mounting holes 14 in the top wall 22 is aligned with respective ones of four corners 34 of the top wall 22 to insertably receive a fastener to attach the top wall 22 to the horizontal support surface 16.

The outer wall 24 has a distal edge 36 with respect to the top wall 22 defining an opening 38 into the housing 12. The back side 26 of the outer wall 24 has respective ones of the mounting holes 14 extending therethrough such that the back side 26 can be mounted to a vertical support surface 40 instead of mounting the top wall 22 to the horizontal support surface 16. The dispensing slot 18 extends through the front side 28 of the outer wall 24, and the dispensing slot 18 extends substantially between the first lateral side 30 and the second lateral side 32 of the outer wall 24. The dispensing slot 18 is positioned adjacent to the top wall 22, and the outer wall 24 has an inside surface 42. The inside surface 42 has a channel 44 extending inwardly therein and the channel 44 extends around each of the first lateral side 30, the second lateral side 32, the back side 26 and the front side 28 of the outer wall 24. Additionally, the channel 44 is positioned adjacent to the distal edge 36.

A pair of holders 46 is each coupled to the housing 12 and each of the holders 46 is positioned within the housing 12. Each of the holders 46 is positioned on opposite sides of the housing 12 with respect to each other to engage a respective end 48 of the rolled sheet 20. Moreover, each of the holders 46 is positioned on a respective one of the first lateral side 30 and the second lateral side 32 of the outer wall 24. Each of the holders 46 has a distal end 50 with respect to the outer wall 24 and each of the holders 46 is collapsible such that the distal end 50 of the holders 46 is movable toward or away from the outer wall 24. In this way the pair of holders 46 can accommodate a variety of lengths of the rolled sheet 20. Each of the holders 46 includes a biasing member 52 that is positioned within the holders 46 and the biasing member 52 in the holders 46 biases the distal end 50 away from the outer wall 24. Additionally, each of the holders 46 has a cylindrical shape to facilitate the rolled sheet 20 to roll on the holders 46.

A base 54 is removably attachable to the housing 12 and the base 54 has a perimeter surface 56. The perimeter surface 56 has a first portion 58 that is recessed with respect to a second portion 60. The first portion 58 intersects a top surface 62 of the base 54 and the second portion 60 intersects a bottom surface 64 of the base 54. Additionally, the first portion 58 has a lobe 66 extending outwardly therefrom and the lobe 66 extends around a full perimeter of the first portion 58. The lobe 66 releasably engages the channel 44 in the inside surface 42 of the outer wall 24 when the base 54 is fitted to the housing 12 for retaining the base 54 on the housing 12. Additionally, the distal edge 36 of the outer wall 24 abuts a threshold between the first portion 58 and the second portion 60 when the base 54 is fitted to the housing 12.

The perimeter surface 56 has a forward side 68 and the forward side 68 corresponding to the second portion 60 has a track 70 thereon. Additionally, the track 70 extends along a full length of the forward side 68. A cutter 72 is slidably coupled to the base 54 and the cutter 72 is slidable laterally along the base 54 to cut the length of rolled sheet 20 that has been drawn outwardly from the housing 12. In this way any length of the rolled sheet 20 can be drawn outwardly from the housing 12 and cut to length.

The cutter 72 comprises a slide 74 that is slidably engaged to the track 70 on the second portion 60 of the forward side 68 of the perimeter surface 56 of the base 54. The slide 74 has a first opening 76 and a second opening 78, and the first opening 76 is positioned on an opposite side of the slide 74 with respect to the second opening 78. Additionally, each of the first opening 76 and the second opening 78 is aligned with the track 70. In this way each of the first opening 76 and the second opening 78 can accommodate the portion of rolled sheet 20 that is drawn outwardly from the housing 12 when the slide 74 is slid in either a first direction or a second direction.

The cutter 72 includes a pair of blades 80 and each of the blades 80 is positioned in the slide 74. Each of the blades 80 has a cutting edge 82 and the cutting edge 82 of each of the blades 80 is aligned with a respective one of the first opening 76 and the second opening 78. In this way each of the blades 80 can cut the portion of rolled sheet 20 that is drawn outwardly from the housing 12 depending on whether the slide 74 is slid in the first direction or the second direction.

Figure 8:
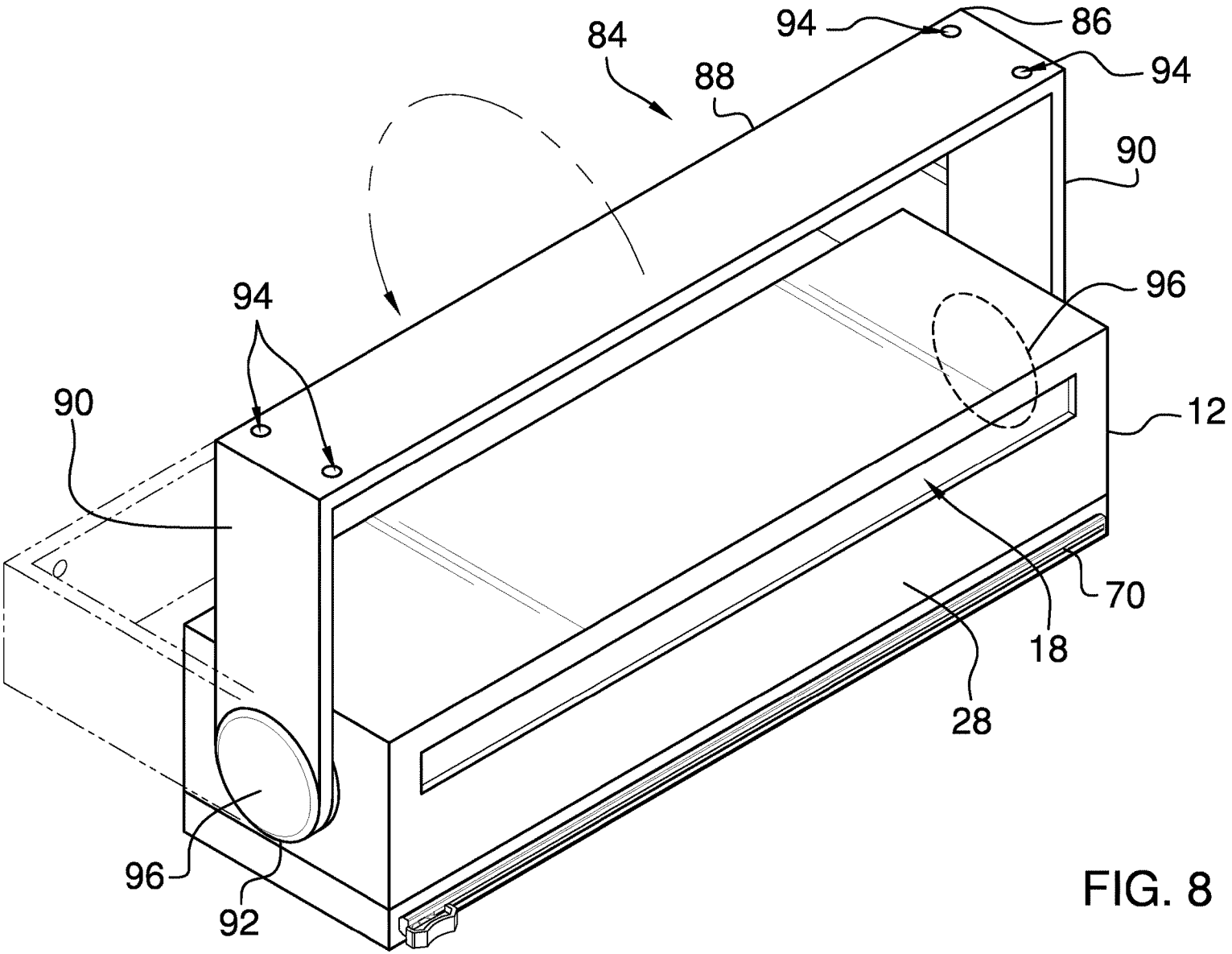
FIG. 8 is a perspective view of an alternative embodiment of the disclosure.

In an alternative embodiment 84 as is most clearly shown in FIG. 8, a handle 86 is included which comprises a central member 88 extending between a pair of end members 90. Each of the end members 90 has a distal end 92 with respect to the central member 88. The central member 88 has a plurality of mounting holes 94 each extending therethrough to accommodate a fastener for mounting the central member 88 to a support surface. A pair of pivots 96 is included and each of the pivots 96 is positioned on a respective one of the first lateral side 30 and the second lateral side 32 of the outer wall 24 of the housing 12. Each of the end members 90 pivotally engages a respective one of the pivots 96 at a point located adjacent to the distal end 92 of the end members 90. In this way the handle 86 can be rotated around the housing 12 thereby facilitating the housing 12 to be mounted to a variety of different support surfaces.

In use, the housing 12 is mounted to the horizontal support surface 16 and the rolled sheet 20 is inserted into the housing 12 such that each of the holders 46 engages the respective ends of the rolled sheet 20. Additionally, an edge of the rolled sheet 20 is extended outwardly through the dispensing slot 18 in the front wall of the housing 12, and the base 54 is fitted to the housing 12. A desired length of the rolled sheet 20 is drawn outwardly through the dispensing slot 18 and is pulled against the front side 28 of the outer wall 24 of the housing 12. The cutter 72 is slid in either the first direction or the second direction, whichever is appropriate for sliding the cutter 72 along the length of rolled sheet 20 that is pulled against the front side 28. In this way the desired length of the rolled sheet 20 can be cut and employed for any desired purpose.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rolled sheet dispenser assembly for dispensing a cutting a selected length of a rolled sheet, said assembly comprising:

a housing having a plurality of mounting holes being integrated therein wherein said housing is configured to be mounted to a horizontal support surface, said housing having a dispensing slot extending into an interior of said housing wherein said dispensing slot is configured to facilitate a rolled sheet positioned in said housing to be drawn outwardly through said dispensing slot, wherein said housing has a top wall and an outer wall extending downwardly therefrom, said outer wall having a back side, a front side, a first lateral side and a second lateral side, said top wall extending outwardly beyond each of said first lateral side, said second lateral side and said front side, said top wall having respective ones of said mounting holes extending therethrough, each of said mounting holes being positioned on respective portions of said top wall that extend beyond said first lateral side and said second lateral side of said outer wall, each of said mounting holes in said top wall being aligned with respective ones of four corners of said top wall wherein each of said mounting holes in said top wall is configured to insertable receive a fastener to attach said top wall to the horizontal support surface, said outer wall having a distal edge with respect to said top wall defining an opening into said housing, wherein said outer wall has an inside surface, said inside surface having a channel extending inwardly therein, said channel extending around each of said first lateral side, said second lateral side, said back side and said front side of said outer wall, said channel being positioned adjacent to said distal edge;

a pair of holders, each of said holders being coupled to said housing, each of said holders being positioned within said housing, each of said holders being positioned on opposite sides of said housing with respect to each other wherein each of said holders is configured to engage a respective end of the rolled sheet;

a base being removably attachable to said housing, wherein said base has a perimeter surface, said perimeter surface having a first portion being recessed with respect to a second portion, said first portion intersecting a top surface of said base, said second portion intersecting a bottom surface of said base, said first portion having a lobe extending outwardly therefrom, said lobe extending around a full perimeter of said first portion, said lobe releasably engaging said channel in said inside surface of said outer wall when said base is fitted to said housing for retaining said base on said housing, said distal edge of said outer wall abutting a threshold between said first portion and said second portion when said base is fitted to said housing, wherein said perimeter surface has a forward side, said forward side corresponding to said second portion having a track thereon, said track extending along said forward side, and a cutter being slidably coupled to said base, said cutter being slidable laterally along said base wherein said cutter is configured to cut the length of rolled sheet that has been drawn outwardly from said housing.

2. The assembly according to claim 1, wherein said back side of said outer wall having respective ones of said mounting holes extending therethrough wherein said back side is configured to be mounted to a vertical support surface instead of having said top wall mounted to the horizontal support surface.

3. The assembly according to claim 1, wherein said dispensing slot extends through said front side of said outer wall, said dispensing slot extending substantially between said first lateral side and said second lateral side of said outer wall, said dispensing slot being positioned adjacent to said top wall.

4. The assembly according to claim 1, wherein each of said holders is positioned on a respective one of said first lateral side and said second lateral side of said outer wall, each of said holders having a distal end with respect to said outer wall, each of said holders being collapsible such that said distal end of said holders is movable toward or away from said outer wall wherein said pair of holders is configured to accommodate a variety of lengths of the rolled sheet, each of said holders including a biasing member being positioned within said holders, said biasing member in said holders biasing said distal end away from said outer wall.

5. The assembly according to claim 1, wherein said cutter comprises a slide being slidably engaged to said track on said second portion of said forward side of said perimeter surface of said base, said slide having a first opening and a second opening, said first opening being positioned on an opposite side of said slide with respect to said second opening wherein each of said first opening and said second opening is configured to accommodate the portion of rolled sheet that is drawn outwardly from said housing when said slide is slid in either a first direction or a second direction.

6. The assembly according to claim 5, wherein said cutter comprises a pair of blades, each of said blades being positioned in said slide, each of said blades having a cutting edge, said cutting edge of each of said blades being aligned with a respective one of said first opening and said second opening wherein each of said blades is configured to cut the portion of rolled sheet that is drawn outwardly from said housing depending on whether said slide is slid in said first direction or said second direction.

7. A rolled sheet dispenser assembly for dispensing a cutting a selected length of a rolled sheet, said assembly comprising:

a housing having a plurality of mounting holes being integrated therein wherein said housing is configured to be mounted to a horizontal support surface, said housing having a dispensing slot extending into an interior of said housing wherein said dispensing slot is configured to facilitate a rolled sheet positioned in said housing to be drawn outwardly through said dispensing slot, said housing having a top wall and an outer wall extending downwardly therefrom, said outer wall having a back side, a front side, a first lateral side and a second lateral side, said top wall extending outwardly beyond each of said first lateral side, said second lateral side and said front side, said top wall having respective ones of said mounting holes extending therethrough, each of said mounting holes being positioned on respective portions of said top wall that extend beyond said first lateral side and said second lateral side of said outer wall, each of said mounting holes in said top wall being aligned with respective ones of four corners of said top wall wherein each of said mounting holes in said top wall is configured to insertably receive a fastener to attach said top wall to the horizontal support surface, said outer wall having a distal edge with respect to said top wall defining an opening into said housing, said back side of said outer wall having respective ones of said mounting holes extending therethrough wherein said back side is configured to be mounted to a vertical support surface instead of having said top wall mounted to the horizontal support surface, said dispensing slot extending through said front side of said outer wall, said dispensing slot extending substantially between said first lateral side and said second lateral side of said outer wall, said dispensing slot being positioned adjacent to said top wall, said outer wall having an inside surface, said inside surface having a channel extending inwardly therein, said channel extending around each of said first lateral side, said second lateral side, said back side and said front side of said outer wall, said channel being positioned adjacent to said distal edge;

a pair of holders, each of said holders being coupled to said housing, each of said holders being positioned within said housing, each of said holders being positioned on opposite sides of said housing with respect to each other wherein each of said holders is configured to engage a respective end of the rolled sheet, each of said holders being positioned on a respective one of said first lateral side and said second lateral side of said outer wall, each of said holders having a distal end with respect to said outer wall, each of said holders being collapsible such that said distal end of said holders is movable toward or away from said outer wall wherein said pair of holders is configured to accommodate a variety of lengths of the rolled sheet, each of said holders including a biasing member being positioned within said holders, said biasing member in said holders biasing said distal end away from said outer wall;

a base being removably attachable to said housing, said base having a perimeter surface, said perimeter surface having a first portion being recessed with respect to a second portion, said first portion intersecting a top surface of said base, said second portion intersecting a bottom surface of said base, said first portion having a lobe extending outwardly therefrom, said lobe extending around a full perimeter of said first portion, said lobe releasably engaging said channel in said inside surface of said outer wall when said base is fitted to said housing for retaining said base on said housing, said distal edge of said outer wall abutting a threshold between said first portion and said second portion when said base is fitted to said housing, said perimeter surface having a forward side, said forward side corresponding to said second portion having a track thereon, said track extending along said forward side; and a cutter being slidably coupled to said base, said cutter being slidable laterally along said base wherein said cutter is configured to cut the length of rolled sheet that has been drawn outwardly from said housing, said cutter comprising:

a slide being slidably engaged to said track on said second portion of said forward side of said perimeter surface of said base, said slide having a first opening and a second opening, said first opening being positioned on an opposite side of said slide with respect to said second opening wherein each of said first opening and said second opening is configured to accommodate the portion of rolled sheet that is drawn outwardly from said housing when said slide is slid in either a first direction or a second direction; and a pair of blades, each of said blades being positioned in said slide, each of said blades having a cutting edge, said cutting edge of each of said blades being aligned with a respective one of said first opening and said second opening wherein each of said blades is configured to cut the portion of rolled sheet that is drawn outwardly from said housing depending on whether said slide is slid in said first direction or said second direction.

8. The assembly according to claim 7, further comprising a handle comprising a central member extending between a pair of end members, each of said end members having a distal end with respect to said central member, said central member having a plurality of mounting hole each extending therethrough wherein each of said mounting holes in said central member is configured to accommodate a fastener for mounting said central member to a support surface.

9. The assembly according to claim 8, further comprising a pair of pivots, each of said pivots being positioned on a respective one of said first lateral side and said second lateral side of said outer wall of said housing, each of said end member pivotally engaging a respective one of said pivots at a point located adjacent to said distal end of said end members thereby facilitating said handle to be rotated around said housing wherein said housing is configured to be mounted to a variety of different support surfaces.

* * * * *